United States Patent [19]

Manabe et al.

[11] 4,114,545

[45] Sep. 19, 1978

[54] AUTOMATIC SEWING MACHINES

[75] Inventors: Takao Manabe, Shizuoka; Sigetugu Matunaga, Numazu, both of Japan

[73] Assignee: Toshiba Kikai Kabushiki Kaisha, Tokyo, Japan

[21] Appl. No.: 786,035

[22] Filed: Apr. 8, 1977

[30] Foreign Application Priority Data

Apr. 15, 1976 [JP] Japan ..... 51-42652

[51] Int. Cl.[2] ..... D05B 21/00

[52] U.S. Cl. ..... 112/121.15; 112/121.12

[58] Field of Search ..... 112/121.12, 121.15, 112/2, 102; 318/569, 571, 574, 575, 576

[56] References Cited

U.S. PATENT DOCUMENTS

| | | | |
|---|---|---|---|
| 2,837,046 | 6/1958 | Carson et al. | 318/571 X |
| 3,227,115 | 1/1966 | Bono | 112/121.12 |
| 3,742,879 | 7/1973 | Schaefer, Jr. et al. | 318/571 X |
| 3,970,016 | 7/1976 | Yanikoski | 112/121.12 |

*Primary Examiner*—Peter Nerbun

*Attorney, Agent, or Firm*—Koda and Androlia

[57] ABSTRACT

In an automatic sewing machine of the type wherein pieces of cloth are clamped between a pair of clamping plates and the clamping plates are moved to follow a predetermined sewing pattern by first and second tables moved in orthogonal directions by motors, the first table takes the form of a hollow rectangular shape and the second table is contained in the first table to be movable in the axial direction thereof. A pair of driving motors are mounted on the stationary portion of the sewing machine and the first and second tables are moved by the driving motors through belts.

2 Claims, 4 Drawing Figures

AUTOMATIC SEWING MACHINES

BACKGROUND OF THE INVENTION

This invention relates to an automatic sewing machine, more particularly to an improvement of a diriving mechanism therefor.

In the mass production of clothes, automatic sewing machines are used for sewing cut pieces of cloths according to a predetermined pattern. In such automatic sewing machine, pieces of cloth are clamped between a pair of clamping plates which are mounted on a supporting head and the head is moved along two axes orthogonally intersecting on the table of the sewing machine to follow a predetermined sewing pattern.

The head is supported by a X table and a Y table which are parallel with the table of the sewing machine and moved in the X and Y directions respectively. In the prior art automatic sewing machine the X and Y tables are mounted one above the other. In this case it is necessary to provide a notch for the sewing machine table for passing supporting members of the X and Y tables and to impart sufficient stiffness to the supporting members. This increases the weight of the members to be driven that is the cloth clamping plates, the supporting head and the X and Y tables. This means that a powerful and expensive driving source is necessary.

In other design, X and Y tables are disposed above the sewing machine table for the purpose of avoiding to form a notch through the sewing machine table. Although with this construction it is possible to decrease the driving power the members of the driving system mounted above the sewing machine table interferes with the sewing operation thus decreasing the operation area. Moreover, it is difficult to construct the driving system to be dust proof, to ensure safeness of the operator and to improve appearance.

SUMMARY OF THE INVENTION

It is an object of this invention to provide an improved driving mechanism for an automatic sewing machine capable of simplifying the construction of the driving mechanism and decreasing the weight of the driven members.

According to this invention there is provided an automatic sewing machine comprising a sewing machine table, a first hollow table mounted above the sewing machine table and provides with an opening at the bottom thereof, a second table contained in the first table and movable in the axial direction thereof, clamping plates for clamping pieces of cloth to be sewed, a supporting member for supporting the clamping plates and connected to the second table through the opening, the sewing machine table being provided with a pair of slits extending in a direction perpendicular to the axis of the first hollow table, a pair of guide rails disposed beneath the sewing machine table in parallel with the slits, a pair of arms depending from the first table to be received by the slits, sliding member supported by the arms and guided by the guide rails, a pair of motors mounted on a stationary portion of the sewing machine beneath the sewing machine table and belts for driving the first and second tables respectively by the motors.

DESCRIPTION OF THE PREFERRED EMBODIMENTS

Figure 1:
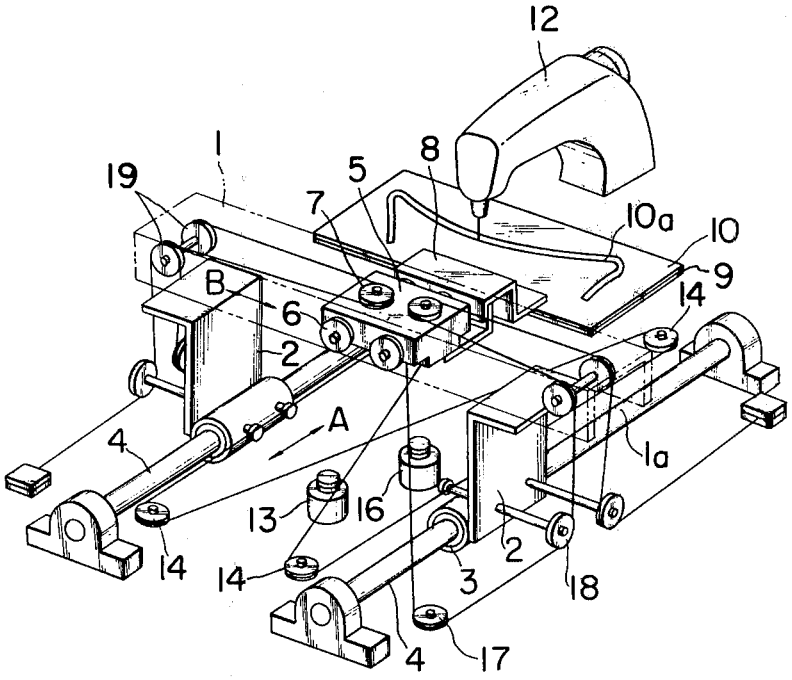
FIG. 1 is a perspective view showing one example of the driving mechanism embodying the invention.
Figure 2:
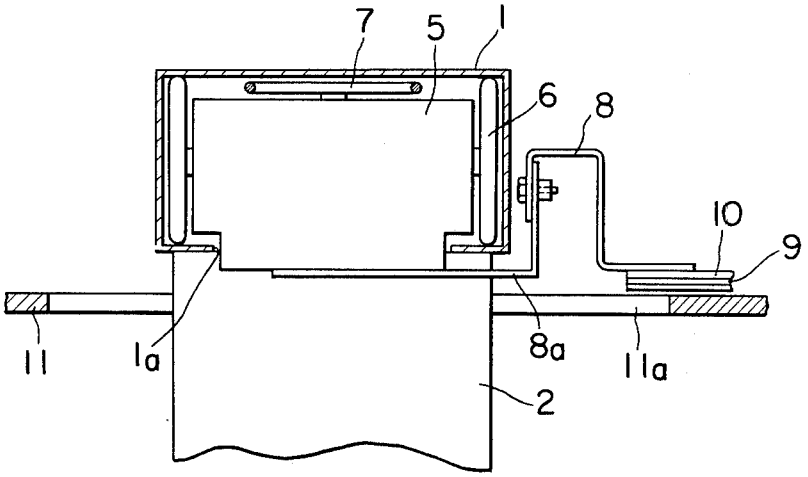
FIG. 2 is a sectional view of a portion of the driving mechanism shown in FIG. 1.

A sewing machine shown in the accompanying drawings comprises a hollow rectangular Y table 1 provided with a notch or opening 1*a* at its lower end. For clarity, in FIG. 1, Y table 1 is shown by dot and dash lines. On the opposite ends of this table, are provided a pair of depending arms 2 which supports bushings 3 at their lower ends. These bushings slidably receive parallel guide rails 4 secured to a stationary member, not shown, of the sewing machine so that the Y table 1 can slide in the axial direction of the guide rails as shown by an arrow A. An X table 5 is contained in the Y table 1 to be movable by rollers 6 in the longitudinal direction B of the Y table 1. As best shown in FIG. 2, rollers 6 are mounted on both sides of table 5 and arranged to engage the upper and lower inner walls of the Y table 1. Furthermore, a pair of pulleys 7 are rotatably mounted on the upper surface of X table 5. As shown in FIG. 2, the lower end of the X table 5 projects through opening 1*a* of the Y table 1 and a head 8 is secured to the projected end.

One end of head 8 is secured to the projected end of table 5 through a lever 8*a* and the other end is used to hold clamping plates 10 for clamping pieces 9 of cloth to be sewed. The clamping plates are provided with slots 10*a* corresponding to a sewing pattern. A sewing machine table 11 is positioned at a height such that its upper surface slidably engages the lower surface of the clamping plate. The sewing machine table 11 is provided with a pair of parallel slots 11*a* to receive the arms 2. The head 12 of the sewing machine for driving a needle, a thread, etc., and the table 11 are secured to a stationary member, not shown.

Figure 3:
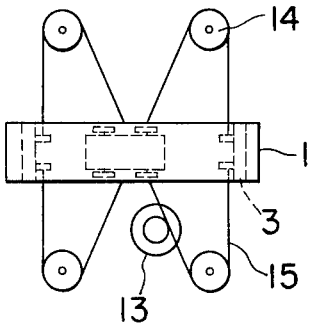
FIGS. 3 and 4 are diagrams showing belt drive arrangements of the Y and X tables, respectively.

An electric motor 13 for driving the Y table 1 is provided beneath the sewing machine table 11 and pulleys 14 are rotatably mounted on the stationary member near the opposing ends of the guide rails 4. As shown in FIG. 3, a belt 15 is passed about the pulleys 14 with its opposite ends connected to bushings 3 at symmetrical points. An intermediate portion of the belt is wrapped about a pulley mounted on the driving motor 13.

Figure 4:
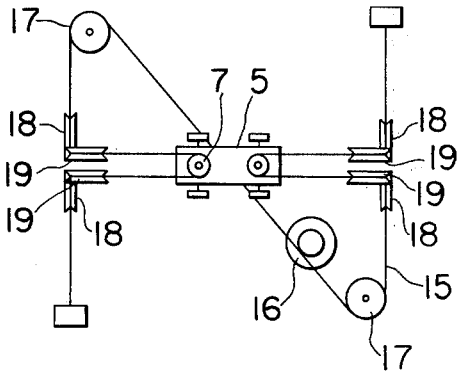

A driving motor 16 for driving the X table 5 is mounted beneath the sewing machine table 11 and a pair of pulleys 17 are symmetrically mounted near the opposite ends of the guide rails 4. Two pulleys 18 are secured to each arm 2 and two pulleys 19 are secured to each end of the Y table 1. As shown in FIG. 4, the belt 15 is passed about pulleys 7, 17, 18 and 19. The opposite ends of the belt 15 are secured to the stationary member and the intermediate portion is wrapped about a pulley mounted on motor 16 for driving the X table 5.

The motor for driving the sewing machine head 12 and motors 16 and 13 for driving the X and Y tables are driven according to a predetermined program corresponding to a predetermined sewing pattern.

When motor 13 is energized sleeves 3 are moved along guide rails 4 in the direction of arrow A by belt 15 thus moving table 1 in the Y direction. At this time, since the length of the portion of the belt 15 between pulley 17 and the stationary member does not vary, the X table 5 would not be moved. On the other hand, when motor 16 is energized the X table 5 is moved in the hollow Y table 1. Of course, at this time the Y table 1 would not be moved.

Pieces of cloth cut to a predetermined shape are clamped between clamping plates 10 which are supported by the supporting head 8. As above described, the motor for driving the sewing machine head 12 and X and Y table driving motors 16 and 13 are program controlled to sew the predetermined pattern.

According to the prior art designe X and Y tables are driven by motors through feed screws so that the weight of the driven members is large. Accordingly, it is necessary to use driving motors having relatively large capacity. According to this invention, since X and Y tables are driven by belts, the load of the driving motors can be decreased. Moreover, as the X table 5 is contained in the hollow Y table 1 the safeness of the operator can be improved. Further, as the motors 13 and 16 for driving X and Y tables are secured to the stationary member their maintenance is easy.

As the belts 13 and 16 may be used wire ropes, chains or piano wires.

We claim:

1. An automatic sewing machine comprising a sewing machine table, a first hollow table mounted above said sewing machine table and provided with an opening at the bottom thereof and pulleys on the opposite ends thereof, a second table contained in said first table and movable in the axial direction thereof said second table being provided with pulleys on the upper surface thereof, clamping plates for clamping pieces of cloth to be sewed, a supporting member for supporting said clamping plates and connected to said second table through said opening, said sewing machine table being provided with a pair of slits extending in a direction perpendicular to the axis of said first hollow table, a pair of guide rails disposed beneath said sewing machine table in parallel with said slits, a pair of arms depending from said first table to be received by said slits, sliding members supported by said arms and guided by said guide rails, a pair of motors mounted on a stationary portion of said sewing machine table, and belts passing about said pulleys of said first and second tables for driving said first and second tables, respectively by said motors.

2. The automatic sewing machine according to claim 1 wherein said first table has a rectangular cross-section and said second table is provided with rollers on both sides thereof, said rollers engaging upper and lower inner surfaces of said first table.

* * * * *